US005464208A

United States Patent [19]

Pierce

[11] Patent Number: 5,464,208

[45] Date of Patent: Nov. 7, 1995

[54] PROGRAMMABLE BASEBALL PITCHING APPARATUS

[75] Inventor: Richard A. Pierce, Davenport, Iowa

[73] Assignee: WNAN, Inc., Sussex, N.J.

[21] Appl. No.: 316,906

[22] Filed: Oct. 3, 1994

[51] Int. Cl.[6] ..... F41B 15/00; A63B 69/00

[52] U.S. Cl. ..... 273/26 D; 124/78

[58] Field of Search ..... 273/25, 26 R, 273/26 A, 26 D; 124/78, 81

[56] References Cited

U.S. PATENT DOCUMENTS

| | | | |
|---|---|---|---|
| 4,632,088 | 12/1986 | Bruce | 124/78 |
| 4,712,534 | 12/1987 | Nozato | 124/78 |
| 4,760,835 | 8/1988 | Paulson et al. | 124/78 |
| 4,915,384 | 4/1990 | Bear | 273/26 R |
| 5,064,194 | 11/1991 | Bixler et al. | 273/26 A |
| 5,125,653 | 6/1992 | Kovacs et al. | 273/29 R |
| 5,195,744 | 3/1993 | Kapp et al. | 273/26 D |
| 5,333,855 | 8/1994 | Silin et al. | 273/26 A |

*Primary Examiner*—Jessica J. Harrison
*Attorney, Agent, or Firm*—Richard T. Laughlin; Ribis, Graham & Curtin

[57] ABSTRACT

The invention relates to a ball pitching machine having a ball feed means for feeding balls to a feeding point where they will be acted upon by rotating drive wheels, a plurality of at least two drive wheels having planes and axes of rotation, said axes of rotation being perpendicular to said planes, said wheels being disposed about said feeding point so as to simultaneously act on a fed ball imparting to the fed ball spin and a forward velocity and trajectory, outwardly away from the feeding point in a direction initially perpendicular to the axes of rotation and in the plane of the wheels. The rotating means is constructed for rotating each drive wheel independent of other drive wheels at a plurality of preselected rotational speeds thereby effecting a type of pitched ball having a predetermined trajectory. A tilting means is provided for altering the trajectory, upwardly or downwardly, in a vertical plane, coplaner with the plane of the drive wheels. A panning means is provided for altering the trajectory of the ball in a plane perpendicular to the plane of the drive wheels. A speed measuring means is provided for determining the speed of the moving ball, and a computer means for inputting at least one set of variables that determine the trajectory based on the speed of the ball and at least one set of variables for effecting the spin applied to the ball by the drive wheel.

14 Claims, 10 Drawing Sheets

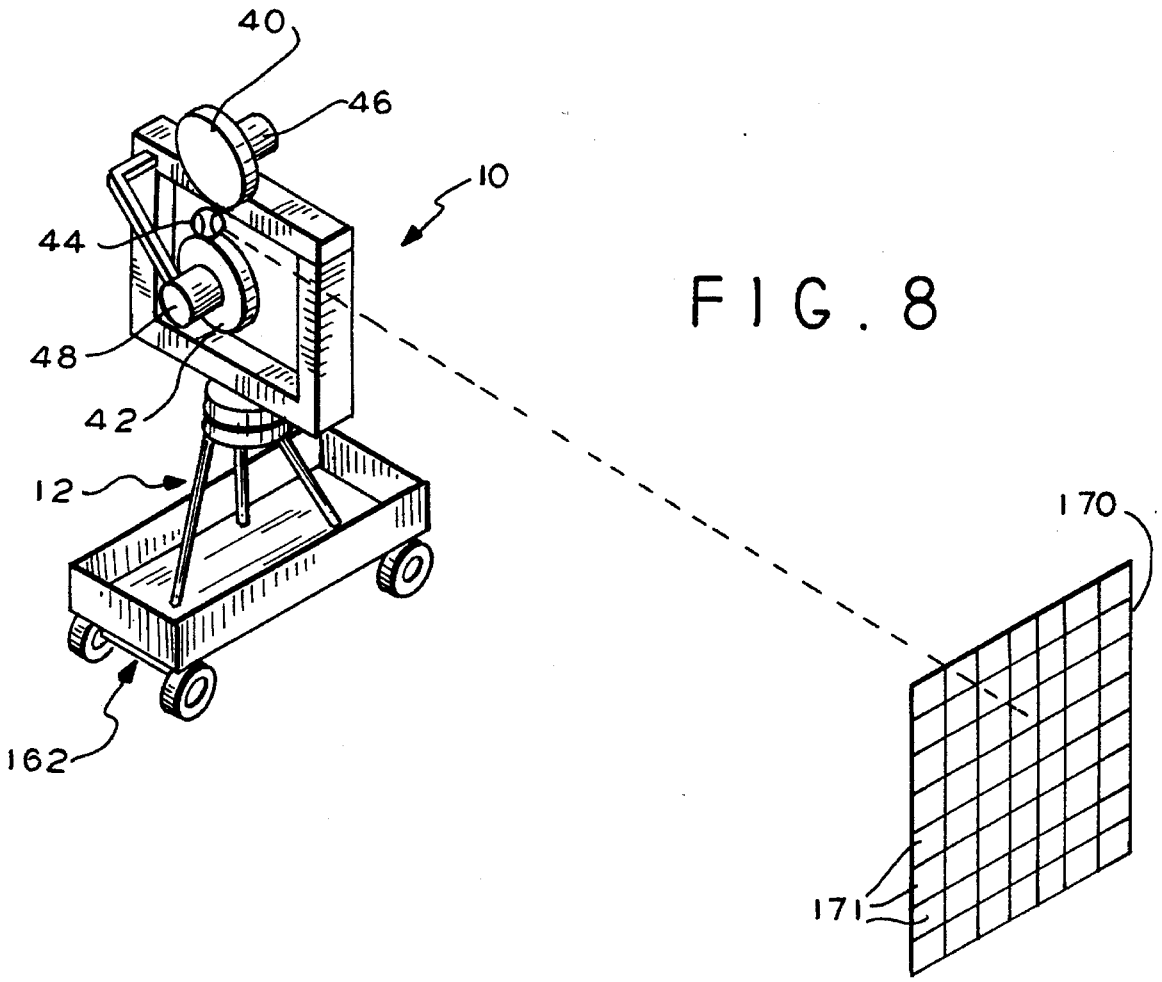
FIG. 8
FIG. 9
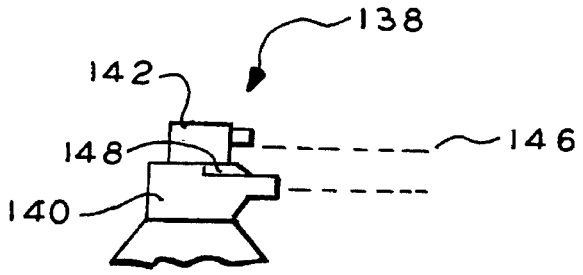

PITCH
FAST BALL
CURVE BALL
CNG UP
S LEFT
S RIGHT
R LEFT
R RIGHT
RISE
SINK
LEFT
RIGHT
NONE
POSITION
SET CENTER
STRIKE ZONE
SIT
PROG
MAN
MEM
RUN
SEQ
31
LEFT WHEEL SPEED
2900 RPM
RIGHT WHEEL SPEED
1400 RPM
BALL SPEED
99 MPH
BATTER
LH
RH
NO. 22
PITCHER
LH
RH
OH
SA
200
201
203
204
210
211
212
213
215
220
221
222
224
225
226
227
228
229
230
231
232
236
240
241
242
245
250
251

PROGRAMMABLE BASEBALL PITCHING APPARATUS

FIELD OF THE INVENTION

The invention generally relates to a baseball pitching machine. In particular, it relates to a pitching machine which is programmed from a remote position to deliver pitches of different types in a predetermined manner utilizing microcomputer programming/controllers.

BACKGROUND OF THE INVENTION

Machines capable of delivering a pitched ball are well known in the art. U.S. Pat. No. 4,860,717 discloses a portable ball throwing machine utilizing a lever arm to throw the ball.

U.S. Pat. No. 3,807,379 discloses a spring type ball projecting device which can be programmed to vary the type of delivery. U.S. Pat. No. 4,844,458 discloses a tennis ball serving machine having panning capability. U.S. Pat. No. 5,012,790 discloses a ball throwing machine utilizing a single tire.

Improved versions of baseball throwing machines utilize counter rotating wheels to give velocity, direction and spin to the thrown ball. These machines are, generally, either of the two or three wheel type.

U.S. Pat. Nos. 4,197,827, 4,655,190 and 4,760,835 disclose ball throwing machines of the two-wheel type. U.S. Pat. No. 4,442,823 discloses a ball throwing machine of the three-wheel type utilizing a complex computer control. U.S. Pat. No. 4,712,534 discloses a ball throwing machine having two separate pairs of throwing wheels, each pair being at right angles to the other, one having the axis of rotation in the vertical position and the other having the axis of rotation in the horizontal position. U.S. Pat. No. 5,125,653 discloses a computer controlled tennis serving machine of the two-wheel type.

Although these devices are effective for the purpose intended, they are difficult to control when producing a variety of different pitches (i.e., slider, drop, curve, etc.) that may be utilized under game conditions.

As the aforementioned patents illustrate, the prior art has seen the development of a wide variety of types of apparatuses for reproducing the flight of a ball—as thrown by the human hand or as hit by a baseball bat, tennis racquet or other accessory. From the earliest pitches in the game of baseball, observers have studied the paths of balls thrown by the human hand, arm and body. Such observations are steeped in controversy. The physics of ball flight, however, require that a ball leave a point of projection, at an initial height from the ground, with a velocity in a given direction and with a given spin rotation about an axis oriented in space, fly through space acted upon by air (through which it travels) and be subject to gravity. It has long been the objective to duplicate these variables by mechanical means.

SUMMARY OF THE INVENTION

It is an object of the invention to provide a pitching machine which can deliver a ball, from a projected point of height, in such a manner as to simulate multiple types of flight of a ball (i.e.., curve right or left, drop, rise, etc.). It is another object of the invention to provide such a machine as would be able to pitch any curve or spin, including spin about the direction of the flight of the ball. A further object of the invention is to be able to simulate right-hand, left-hand, sidearm, overhand or other types of delivery of the ball as performed by the human hand, arm and body. A still further object of the invention is to provide such a machine which can vary the height, speed and spin of the initial delivery of the ball, in an accurate manner, so that the batter can learn to compensate for such differences in flight of the ball as it is projected over home plate. A still further object is to be able to vary the azimuth angle to compensate for the spin and curve and thereby pass through the target plane or strike zone. Other objects and the advantages of the invention will appear from the following detailed description.

This invention relates to a computer operated baseball pitching machine. In particular, the pitching machine can be controlled to deliver a series of pitches having predetermined spins and trajectories by controlling the spin of the ball, the speed of the pitch and the angle from which the ball starts its path. Further, the types of pitches delivered by the pitching machine can be determined and then programmed into a memory of the microprocessor to be delivered in a number of different sequences as called up from the memory point at a later time. The predetermined program will control and run the speed, spin, azimuth and starting projectile point of the ball in a full range capacity from right-handed, left-handed or overhand style pitches. In the alternative, the sequence of the pitches can be randomly determined, being selected from a store of various modes of pitches contained in the memory of the computer or in computer software accessible by the computer. In addition, individually styled pitches can be determined by a person in control of the computerized programmer/controller.

The computer operating system of this invention is utilized to control pitching machines of the two-wheel type, but can be modified through the addition of various hardware components to control three-wheel type machines, as well as being able to retrofit to work with existing motor controls on other pitching machines.

The apparatus has the driving motors on the opposing sides of the wheels. This enables the apparatus to have stability when rotated and also allows the motors to be run in the same direction. Voltage measuring devices are provided at each of the motors so the voltage flow for the particular configuration can be measured, recorded by the computer and repeated at will.

The foregoing and other objects, features and advantages will be apparent from the following description of the preferred embodiment of the invention as illustrated in the accompanying drawings.

BRIEF DESCRIPTION OF THE DRAWINGS

The foregoing and other objects, features and advantages will be apparent from the following description of the preferred embodiment of the invention as illustrated in the accompanying drawings.

FIG. 8 is an isometric view showing a mobile unit for carrying the pitching machine of the invention and a target arrangement.

FIG. 9 is a partial view of a video camera, infrared light source, pulse generator and timing device according to another embodiment of the present invention;

DESCRIPTION OF THE PREFERRED EMBODIMENT

Figure 1:
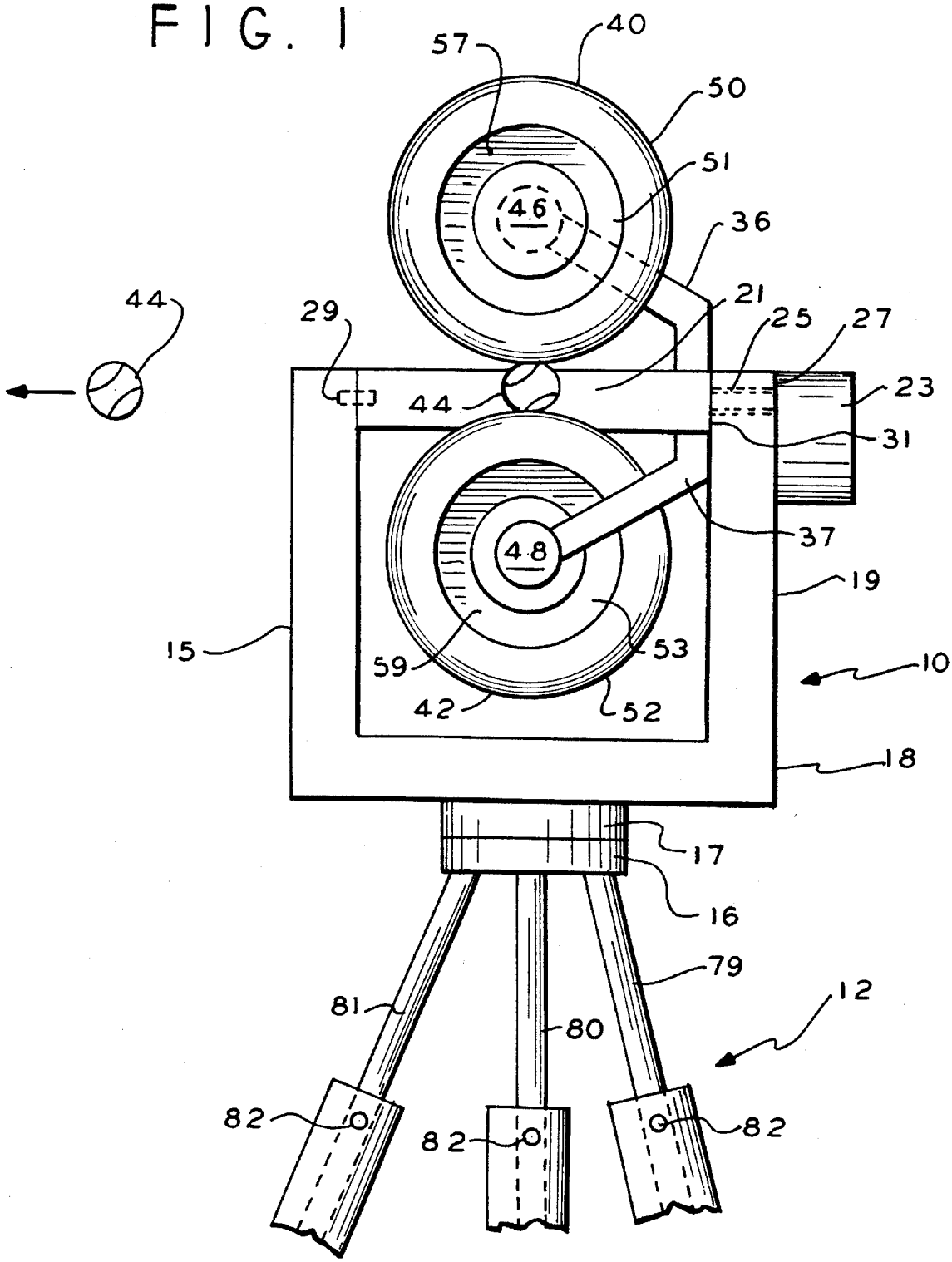
FIG. 1 is a front perspective view of a pitching machine according to the present invention showing the wheels in a vertical configuration.

This invention relates to a computer operated baseball pitching machine utilizing a computer controller, solenoids and stepping motors, potentiometer, gear works and mainframe support for the purpose of propelling a round baseball or equivalent in a predetermined fashion.

The pitching machine of the invention is a fully automatic apparatus which can approximate the majority of pitches thrown by both right-handed and left-handed pitchers by utilizing a programmed entry. The unit will also approximate the majority of pitches thrown by sidearm or overhand pitchers. This is accomplished by the utilization of a series of bearing mounted sleeves that are part of a framework providing support to the main projecting wheels of the unit, giving the wheels the ability to be moved horizontally, vertically and to rotate from center (straight up and down), which can be remotely controlled to move the projecting angle of the firing cannon left or right, approximately 5° to 15°, up and down, approximately 10° to 20°, and in rotation 180° from center, 90° in left or right direction. In addition to and at the same time, the programming/controller will control the speed of each tire individually, working in conjunction with pulse counting methods and/or voltage control methods to insure accuracy of speed to provide the ball with the various spins needed to accomplish different types of pitches to be delivered to a predetermined target at the home plate in or out of the strike zone. In this manner, the desired spin, position, speed and projection of the ball can be predicted and controlled for programming memory or position. The apparatus can be preset so that a selection of a particular pitch can be accomplished by use of the remote programmer/controller or the controls can be set to produce a random selection of pitches spaced apart in an acceptable time frame to simulate the actions of a live pitcher. An optional shield of metal or plastic is provided to hide the movement of the apparatus from the batter so he/she cannot anticipate the pitch based upon tire position and angle.

The pitching machine, as described in one embodiment, utilized in the practice of this invention, is based upon a two-tire design. The tires are used to project the ball, control the spin and speed of the ball by rotating in opposite directions at separate speeds and being spaced apart in such a manner as to compress around the ball, when fed in between the tires by gravity and from behind, causing the ball to move between the tires and ultimately be projected from the front of the tires through a cannon or barrel in the front of the machine. Each of the wheels preferably includes a rigid central hub assembly of cast aluminum suitably having a flat cylindrical rim about ten inches in diameter for supporting a body or tire of elastomeric material. The rim is a solid elastomeric material of the same nature as used on tires on automobile tires. Each such elastomeric body is formed witch either a flat surface at the outer most portion of the body or with a peripheral groove providing a concave cross-section in said body extending circumstantially around the perimeter of the wheel for receiving a baseball or equivalent and for channeling the trajectory of the baseball or equivalent when the wheels rotate in opposite directions of each other at high rates of speed. The baseball or equivalent will then be projected forward in a controllable fashion being projected outward from the wheels with predetermined axis of spin causing predictable path flights of the ball from the wheels to the point of destination approximately sixty feet away.

The elastomeric body is grooved around the periphery thereof to supply a concave ball engaging the surface. The concavity of the groove includes a first radius of curvature on either side of body and a central, smaller radius of curvature is indicated at the center. The latter radius of curvature extending more deeply into body to provide greater relief underneath the baseball or equivalent received thereupon. It is understood the curvature as indicated at is a part of the same circular arc cross-section even though separated by curvature. The tires are generally spaced more closely than the diameter of the baseball or equivalent whereby the baseball or equivalent is grasped there between as a result of the compression of the elastomeric body and slight compression of the opposite elastomeric body.

Various materials may be employed for the elastomeric bodies of both styles of wheels as described above and throughout this description. For instance, a suitable natural or synthetic rubber may be employed. However, other substances may be preferred, from the standpoint of accurate ball protection operability according to the present invention as well as durability in maintaining the desired dimensions and exhibiting a long working lifetime. A preferred material is a so-called solid elastomer having a sure diameter hardness of approximately 40A or greater, and particularly a polyurethane elastomer of that hardness. In the event that a pneumatic type tire is used on the wheel, such as in the case of the convex tire, air pressure within the tire will be used to support the grabbing surface of the wheel from within the unit. In this case, the amount of pressure within the tire will be critical to the operation and accuracy of the unit and will require the use of valve stems mounted in the rims of the wheels allowing for user maintenance. In either case, the pitching machine according to the present invention has the ability to channel a baseball or equivalent into a true control trajectory tangential to the ball engaging wheels and in the plan of the drive wheels as determined by the frame work of the cannon and feed tube. The trajectory of the ball is controlled for long distances in a constant manner to a predetermined location in a target area, usually, but not limited to, sixty feet away from the machine.

The two wheels either convex or concave design, which grip each side of the baseball or equivalent to be thrown are driven by independent motors. The motors are rigidly connected to strut which is affixed to the base and in such manner as to have the motors on opposite sides of each other. In this fashion, true balance is achieved for the purpose of each of rotation in a 180° arch to be described in detail later in this application. This method of mounting of the motors also allows for the motors to be driven in the same direction electrically while creating the situation of moving the wheels in opposite directions for proper projection of a baseball or equivalent as described earlier in this paper. The rate of speed of each motor is controlled though the programming/controlling computer to give the desired degree of spin to the ball as well as the speed at which the ball is projected away from the apparatus. In this invention, the speed of the motors will be determined by either the consumption of electrical energy necessary to achieve a predetermined ratio of a spin and/or by a count pulse as provided by a device mounted on the base of the unit and aimed at the hub of the wheel. This rate of rotation will be controlled by the programming/controlling computer interface in such a manner as to insure the proper speed and spin as applied to the baseball or equivalent for the required results of curve, drop, rise, or any other need of the projectile after it leaves the apparatus toward its targeted area. The speed of the baseball or equivalent, since predetermined, can be displayed on the programmer/controller for the information and use by the person in control of the unit. This speed control will also be used as one of the several pieces of information needed to install electronically in the memory of the unit to allow for a predetermined or random selection of automatic pitches. Since each time the wheels are compressed around a projectile and the speed of the motors are decreased in a predictable manner, it is imperative that the wheels and their driving motors are allowed to come back to program speed for accuracy. For this reason, a solenoid type switch and lever is to be installed in the feed channel of the ball shoot to prevent a baseball or equivalent from being allowed into the projectory channel of the wheels prior to either or both wheels from reaching maximum speed required for a specific type of pitch. This will insure an accuracy of repetitiveness between like pitches not achievable by any machine on the current market today. The motors, since being constantly monitored for rate of spin, will be automatically fed electric energy in such a manner as to increase immediate torque and spin ratios immediately after the passing of each pitch. This will insure that the motors maintain their predetermined and programmed speed at all times with a minimum of down time between allowable pitches.

The drive motors themselves are of an electrical type utilizing a pulsed DC or a current-monitored AC electricity for control of a variable rate of speed. They are of sufficient amperage and torque as to insure the quick return rate of a rotation between pitches, as well as a fast start-up during the initial setup of the machine.

Figure 2:
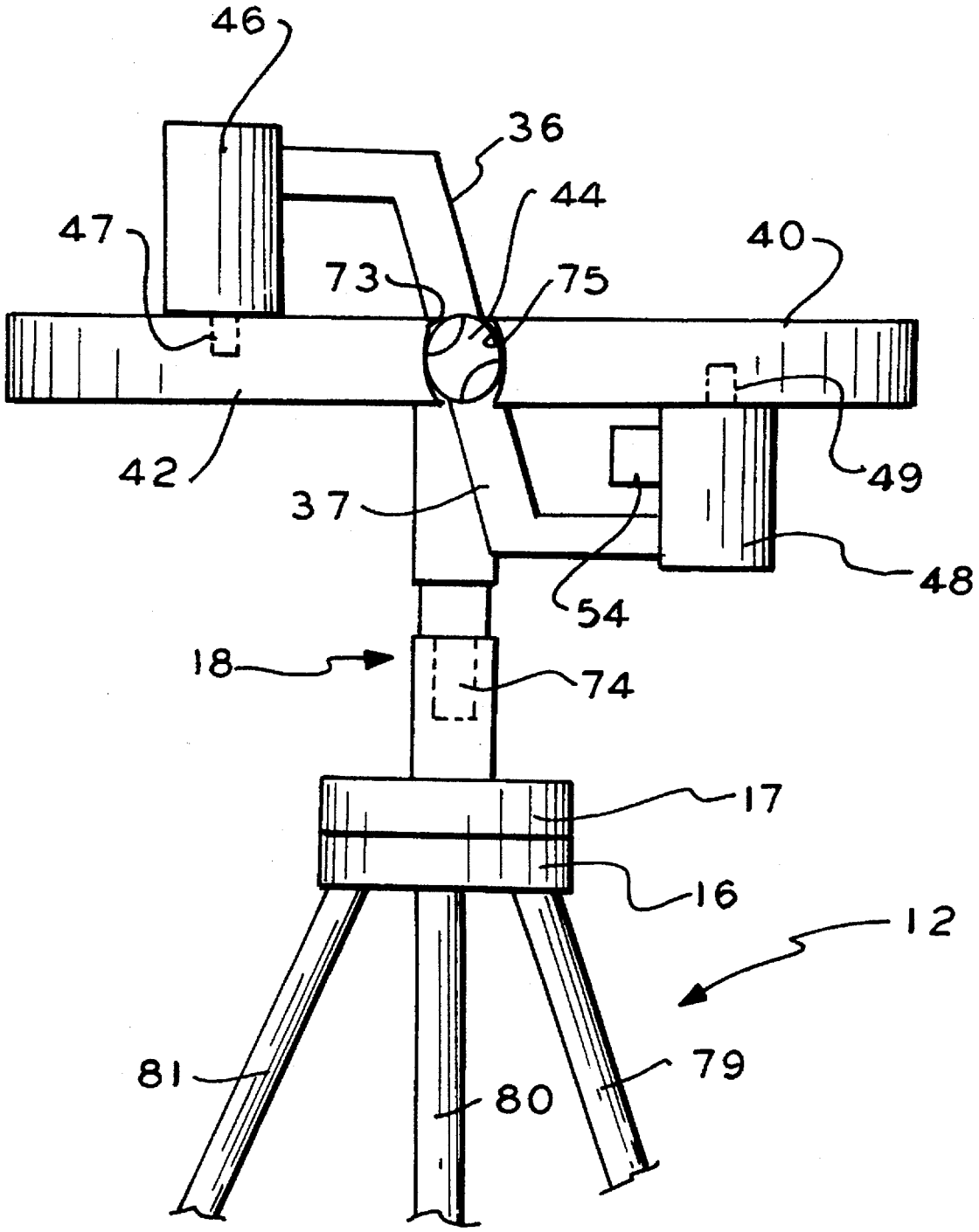
FIG. 2 is a front perspective view of a pitching machine according to the present invention showing the wheels in a horizontal configuration.
Figure 4:
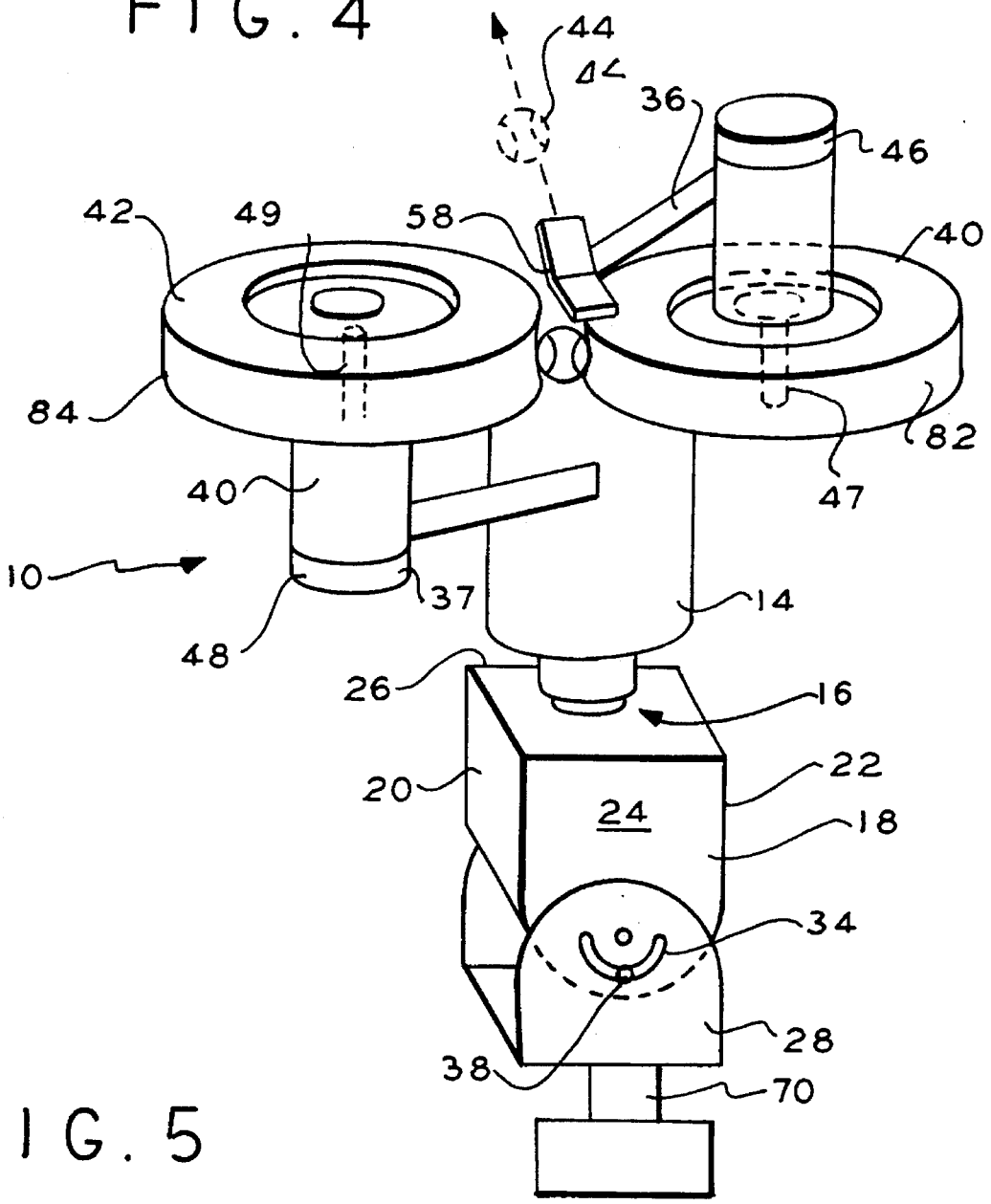
FIG. 4 is a perspective view of one embodiment of the invention, partially broken away, showing the side elevation of the platform for controlling the movement of the pitching machine according to the present invention.
Figure 5:
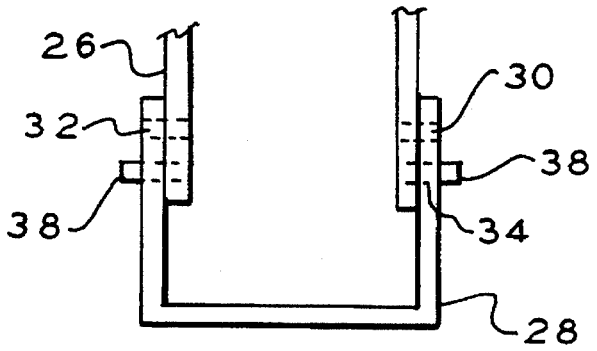
FIG. 5 is a perspective view, partially broken away, of the motor and gear for controlling the horizontal and vertical movement of the pitching machine according to the present invention.

The preferred two wheel machine will be described, referring to FIGS. 1, 2 and 4. A pitching machine generally indicated at 10 is provided with a base or stand generally indicated at 12 The stand as illustrated is a three leg 79 80 and 81, tripod stand of any desired length. The length of the legs can be made adjustable by utilizing telescoping tubular pieces which have a set screw 82 in each leg to adjust the length or can have a collar which when twisted applies pressure to the two telescoping pieces of each leg so they are ridged and will not slip. As an alternate the legs can be part of a mobile cart generally indicated as 162 in FIG. 8. This cart for the ball throwing machine can have the configuration as shown in U.S. Pat. No. 4,442,823, issued Apr. 17, 1994 to Floyd, et al. for making it mobile and controllable remotely.

Figure 11:
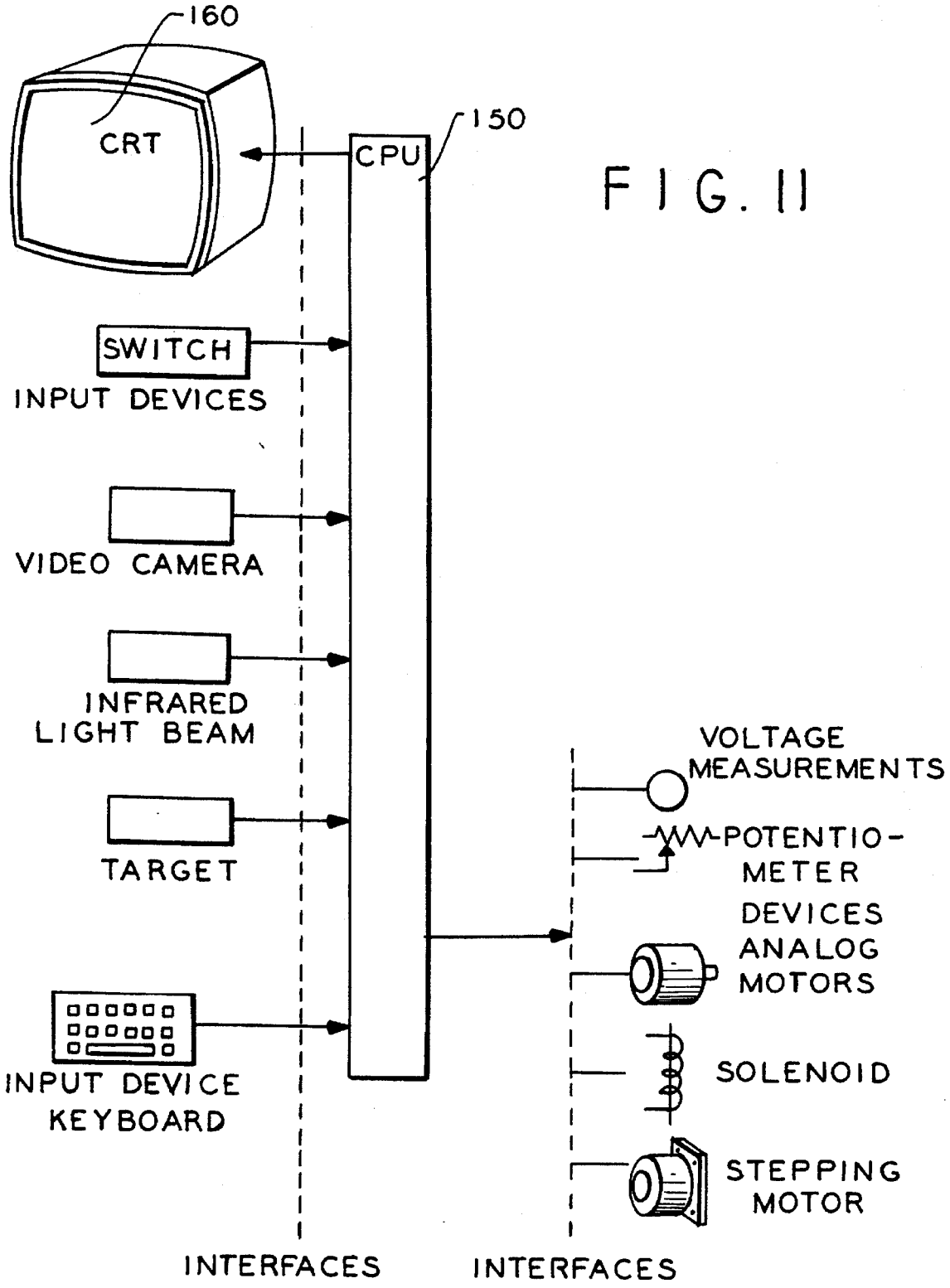
FIG. 11 is a schematic illustration of the interface of the input and output devices.

The legs or base are affixed to a servo unit 16 for rotation parallel to the surface on which the stand rests. The servo unit 16 has a stepper motor 17 which will rotate the rectangular frame 18 which holds the ball throwing mechanism. The motor 17 is under control of the computer 150 through an electrical switch which when activated through a solenoid controls the flow of electricity to the motor through a potentiometer as illustrated in FIG. 11.

The frame 18 can be of generally rectangular box metal configuration with base member 13 generally parallel to the supporting surface and affixed to the drive shaft of the motor 17 so that the frame rotates horizontally as the motor shaft rotates. The frame has generally parallel sides 15, 19 of similar construction which are perpendicular to the base member 13. At the top of the sides is a connecting crosspiece 21 of similar construction or can be of tubular construction, parallel to the supporting surface which is journaled 29, 31 to the sides to allow movement through an angle of approximately 90°. The movement of cross-piece 21 is controlled by a stepper motor 23. The stepper motor is connected to the cross-piece 21 through its rotating shaft 25 at one end of the shaft after it passes through one of the perpendicular sides 19. The shaft 25 passes through bearings 27 in the side piece 19 to allow easy rotation of the motor shaft 25. The motor 23 is controlled from the computer 150 through a solenoid switch which controls the flow of electricity through a potentiometer to the motor 23. The purpose of this motor is to move the ball throwing wheels 40, 42 from a position where they are horizontal to a point where they are approximately in a vertical position.

The ball throwing device has two wheels 40, 42 which grip each side of the ball 44 to be thrown and are driven by independent motors 46, 48. The wheels 40, 42 have mounted pneumatic or solid tires 50, 52. The electric motors drive the wheels in opposite directions of rotation and grips the ball 44 between the tires 50, 52.

The housings for the electric motors 46, 48 are secured to the base strut by bolts or the like not shown. The output shafts 47, 49 of the electric motors are affixed to the hubs of the two wheels 40, 42.

The spacing between the confronting surfaces of the tires 50, 52 is slightly less than the diameter of a ball 44 to be pitched. The ball is gripped between the rotating tires and propelled therefrom as illustrated in FIG. 1. The drive motors are of the electric type of variable speed to accommodate adjustment of the rotational speed of each wheel independently of the other. The speed of the motors is controlled by electrical box 54 which contains a potentiometer for controlling the speed of rotation and is connected by twin electric wires (not shown) to the motors. The motors are rigidly connected to struts 36 and 37, respectively. The struts are rigidly affixed to the cross-piece 21. The speed of each motor is controlled through the computer 150 to give the desired degree of spin to the ball as well as the speed at which the ball is projected away from the apparatus.

Figure 6:
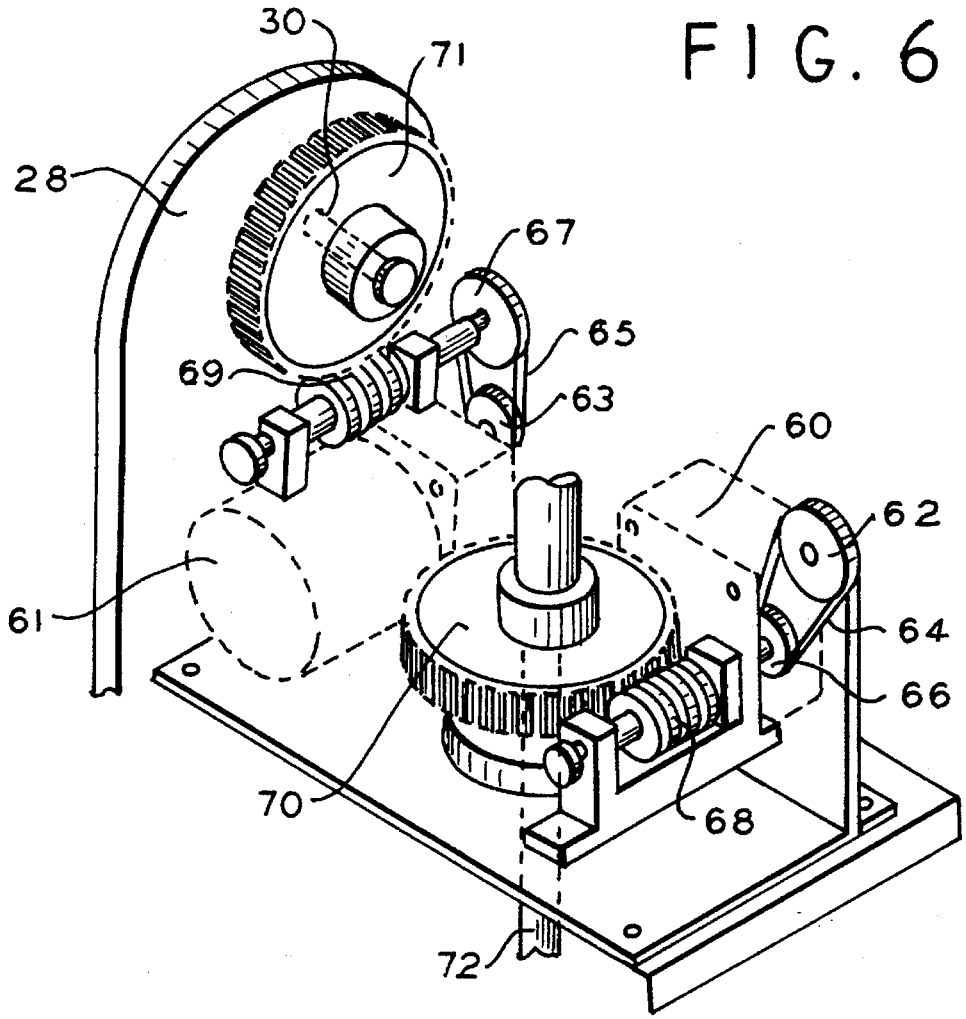
FIG. 6 is an isometric view, partly in section, of an embodiment of the invention showing the drive mechanism for controlling the rotation.

A second embodiment of the invention includes a tilt and pan mechanism generally indicated at 12, and a series of servo units of motors and switches controlled through computer 150 by utilizing a keyboard or a series of contact switches located on a display board. In this configuration, the pitching unit has a base member 14 which rotates 180° by servo unit 16. The servo unit is affixed to a flat tilt plate 18 having two vertical side plates, 20, 22 and vertical front 24 and back 26 plates. The front plate 24 and side plates 26 are connected to a U-shaped base 28 at right and left pivot points 30 and 32. A concave cutout 34 is provided in the base 28 through which a pin 38 affixed to the front plate 24 extends through the cutout to act as a limit on the horizontal movement of the tilt plate 18. The limit is preferably 180°. The two wheels 40, 42 which grip each side of the ball 44 to be thrown are driven by independent motors 46, 48. The motors are rigidly connected to struts 36, 37 which are affixed to the base. The speed of each motor is controlled through the computer 150 to give the desired degree of spin to the ball as well as the speed at which the ball is projected away from the apparatus. In the modification shown in FIG. 6, the rotation and tilting of the pitching machine is driven by two electric motors 60, 61 shown in phantom. Each electric motor rotates a wheel 62, 63 connected by a belt drive 64, 65 to a second wheel 66, 67 which drives a worm gear 68, 69 which in turn drives a gear 70, 71. One of the gears 70 is affixed through rod 72 which rotates the base member 14 in a horizontal plane. The second gear 71 is connected to the pivoting pin 30 which moves the U-shaped base 28 to cause it to tilt the pitching apparatus in the vertical plane. A hydraulic cylinder 74 is used to adjust the pitching level in the vertical direction by raising or lowering the apparatus. This feature allows the selection of the level that a given pitcher will be first releasing the ball.

An infrared measuring device can be provided to measure the speed the ball is traveling by utilizing a timer 148 which times the distance between two points of the ball travel and relay that time to the computer which calculates the speed the ball is traveling and displays the information on the screen of the monitor 160, if desired. A video camera 140 can be provided so the path of the pitch can be observed as it passes over the plate. The camera permits adjustments in the path of the ball and creation of a memory of pitches in combination with a sensor screen generally indicated at 170. Since the camera records the spot of the pitch as it passes over the plate, it is desirable for the movement of the camera to be independent of the movement of the pitching device. This can be accomplished by placing the camera in a typical gyro mount utilized for a compass on a boat. By the use of weights on a pivoting frame, the camera will always be maintained parallel to the ground.

Figure 7:
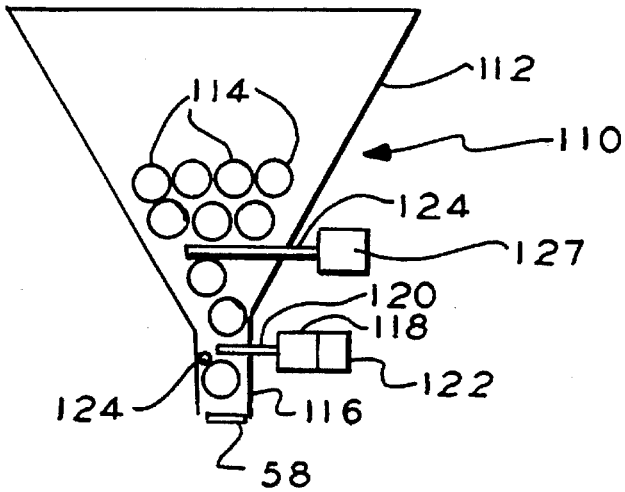
FIG. 7 is a partial cross-sectional view of a ball hopper feed according to an embodiment of the present invention.
Figure 10:
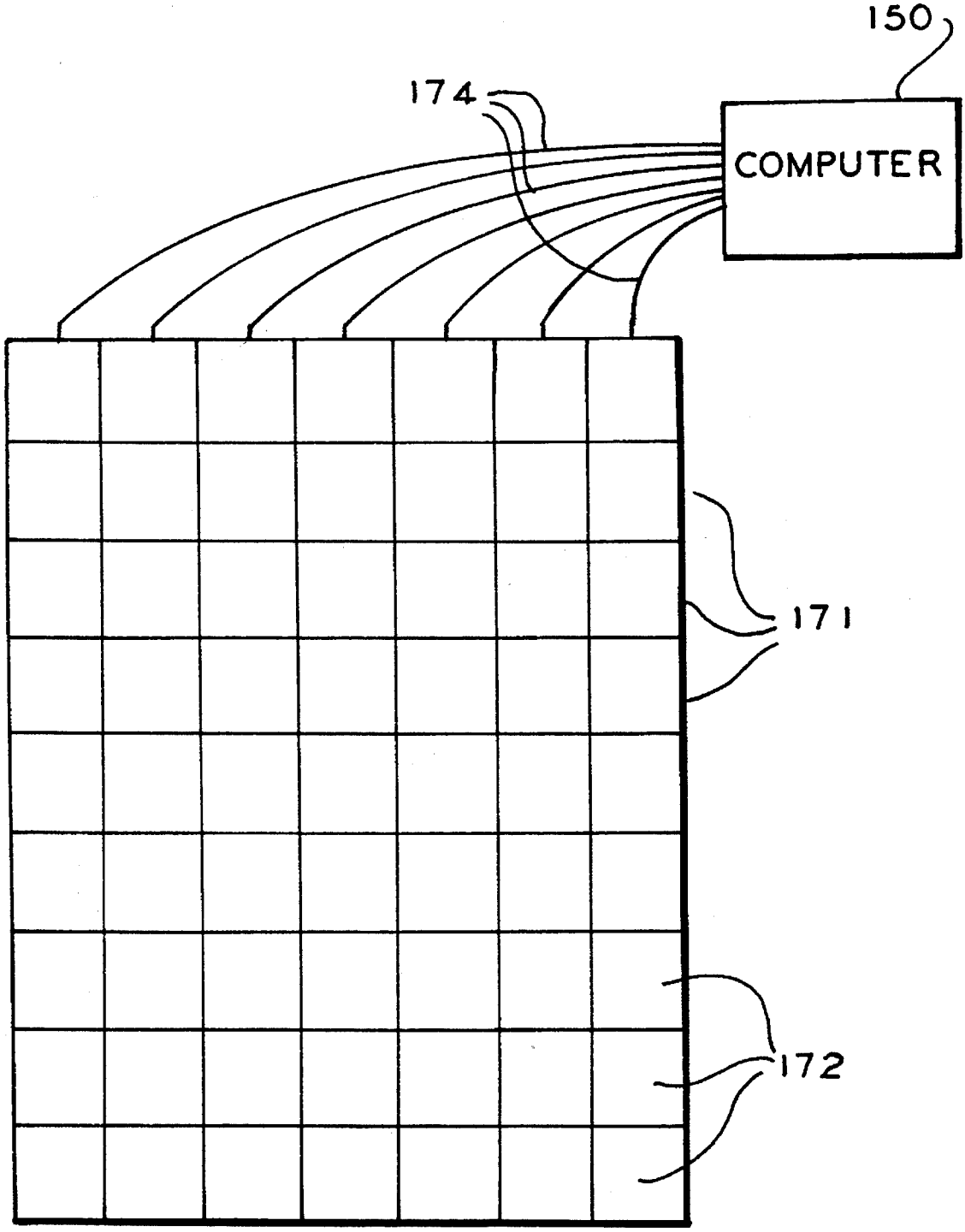
FIG. 10 is a frontal view of a screen containing infrared light responsive cells according to the invention for adjusting the pitches and building up an inventory of instructions.

In FIG. 7 an apparatus is shown for feeding the balls automatically to the rotating tires. The ball feeder generally indicated at 110 has a hopper 112 for holding the balls 114. This feeder includes a delivery section 116 which is secured to the cute 58. The delivery section 116 is of tubular shape and the inner bore of which is slightly larger in diameter than the ball to be pitched. The hopper is provided with a gate 118 which has a plate 120 extending into the hopper to feed one ball at a time. The gate is controlled by a solenoid 122 which, when activated, will cause the gate to slide horizontally and allow one ball to pass the gate. A contact switch 124 located below the gate indicates the passage of a ball and causes the solenoid to be deactivated. Since the balls 114 in the hopper will bunch up, a finger 124, also solenoid activated 127, is provided which stirs up the balls in the hopper.

The video camera 140 is located on the apparatus in the plane in which the ball will be pitched. The video camera has a small light source 142 which projects a narrow beam. This is utilized to line up the apparatus by viewing the monitor in relation to a screen 170 placed at the plate as a temporary target. The screen 170 contains a series of light sensor cells or impact switches 171 across the face of the screen 170. The apparatus is swiveled until the light beam contacts the desired point on the target to obtain the desired projectory of the ball. Alternatively, the ball is pitched and the contact point of the ball with the screen as noted by the impact switches is recorded along with the settings which caused the ball to arrive at such point. All moving mechanical parts are electronically controlled by the microcomputer.

Each of the wheels preferably includes a rigid central hub portion 51, 53 of cast aluminum suitably having a flat cylindrical rim 57, 59 about ten inches in diameter for supporting a body or tire 50, 52 of elastomeric material. For instance, wheel 40 includes an aluminum hub portion 51 having a cylindrical rim 57 which supports a tire 50 of elastomeric material. Similarly, wheel 42 comprises an aluminum hub 53 carrying a cylindrical rim 59 upon which elastomeric tire 52 is mounted. Each such elastomeric body is preferably formed with a peripheral groove providing a concave cross-section in said body extending circumstantially round the perimeter of the wheel for receiving a baseball and for channeling the trajectory of the baseball when the wheel rotates. The baseball will then be pitched in a controllable, forward direction.

The elastomeric body 50, 52 is grooved around the periphery thereof to supply a concave ball engaging surface 73, 75. The concavity of the groove includes a first radius of curvature as indicated at 76 on either side of body 50, 52 and a central, smaller radius of curvature is indicated at 78. The latter radius of curvature extending more deeply into body 52 to provide greater relief underneath the baseball received thereupon. The tires 50 and 52 are in general spaced more closely than the diameter of baseball whereby the baseball is grasped there between as a result of the compression of the elastomeric body and slight compression of the opposite elastomeric body 52.

In a two wheel machine as described wherein adjacent grooves are juxtaposed for receiving the ball there between, it will be apparent to those skilled in the art having access to this disclosure that a pitching machine may also be constructed with three ball engaging wheels such as that described in U.S. Pat. No. 4,442,583 issued Apr. 17, 1952 to Floyd et al., incorporated herein by reference, may be utilized.

The pitching machine according to the present invention has particular advantage because of its ability to channel the ball to center and pitch the same into a true controlled trajectory tangential to the ball engaging wheels and in the plane of the drive wheels as determined by the grooved wheel periphery. The trajectory of the ball is controlled for longer distances, and also this control is effective for longer periods of time than would be possible, for example, in the case of pneumatic tires which tend to lose pressure. Thus, the pitched ball may be accurately propelled consistently to a predetermined location in a target area. The pitching machine as described can rest on a support base which can be a wheeled cart or a tripod. Preferably, the base is equipped with wheels so that the pitching machine will be fully portable.

Tilt and pan refer to adjustment of the direction of flight of the ball vertically and horizontally respectively. Vertical tilt adjusts are in the plane of the drive wheels while pan adjustments are made in a plane generally perpendicular to the drive wheel plane.

Figure 3:
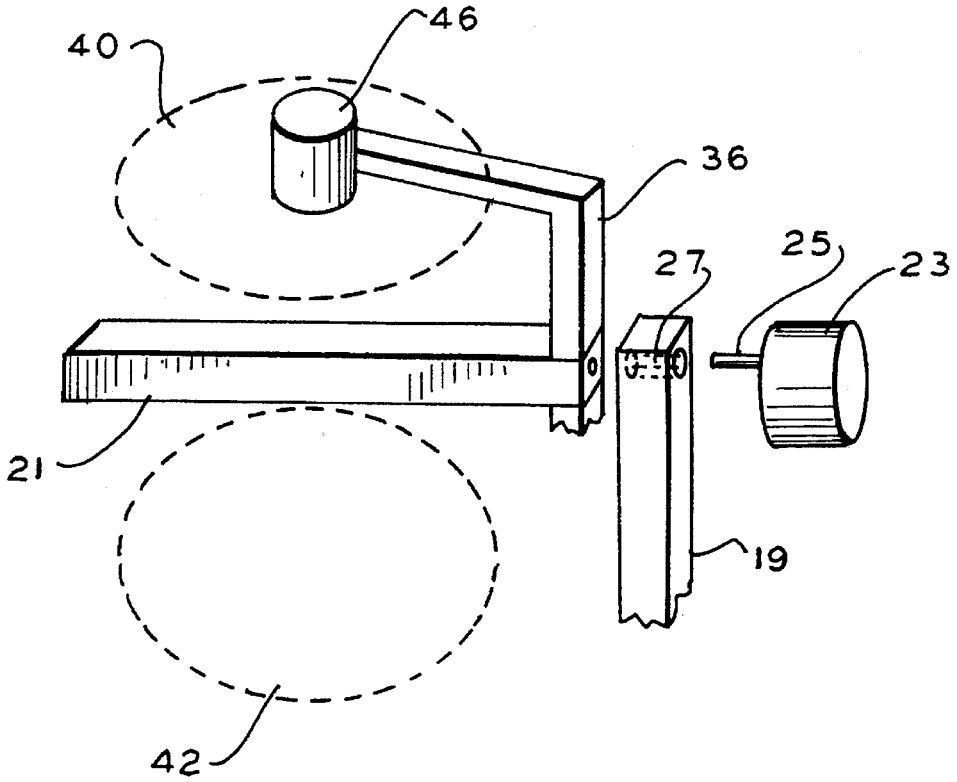
FIG. 3 is a perspective view, partially broken away, showing the support for the wheels and the rotating support for changing the configuration of the wheels from the vertical to the horizontal.
Figure 3A:
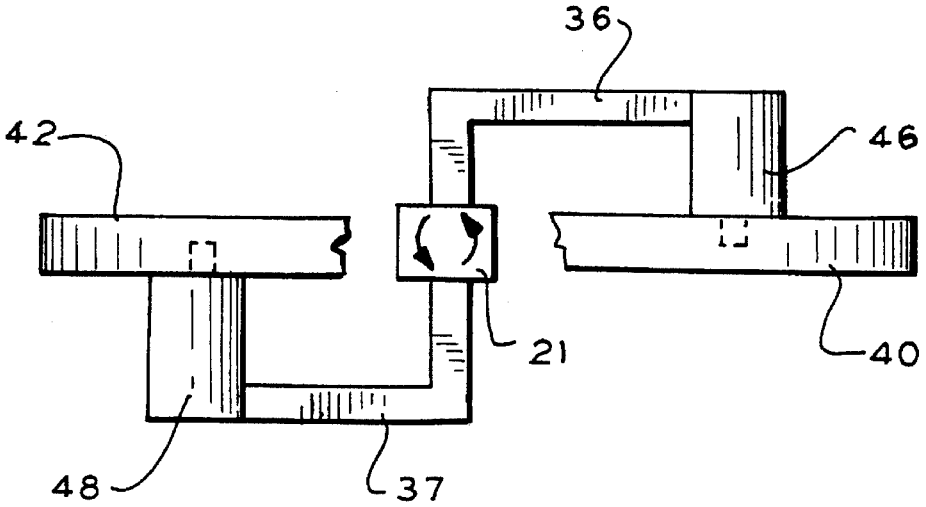
FIG. 3A is an illustration of a cross-piece in relation to the struts as shown in FIG. 3.

The speed of the respective motors 46 and 48 can be adjusted by means of an electrical rheostatic control or potentiometer operated from the keyboard or control switch. By simultaneously increasing the speed of the two motors, the speed with which the ball is projected can be increased. With both motors operating at relatively the same speed, a straight ball is "thrown" simulating a knuckle ball or floater, or a pitch with substantially no spin or rotation. For fielding practice, this type of ball projection simulates a ball hit squarely by the bat such as a line drive or fly ball. By increasing the speed of the top wheel and/or decreasing the speed of the bottom wheel, a ball is projected which has a tendency to drop or curve downwardly because of the spin imparted to the top of the ball. For fielding practice, this type of spin simulates a "grounder." By increasing the speed of the bottom wheel and/or decreasing the spin of the top wheel, a ball is thrown which has a tendency to rise or curve upwardly, such as a fast ball, because of the spin imparted to the bottom of the ball as illustrated by the arrow adjacent ball 106' in FIG. 3. This type of spin also simulates a ball hit off the top of the bat such as a high fly ball utilized for outfield practice.

As indicated, the speed of the wheels as well as the pan and tilt are controlled by a computer program. A computer system, comprising a computer, servo motors and potentiometer, is used to make adjustment to the parameters which effect the type of pitch delivered by the pitching machine.

The wheel drive motors as well as the pan/tilt machine, can be interconnected through connectors to the servo unit comprising servo motors and rheostats, all of which are controlled by the computer.

The computer can have its own keyboard or can be controlled from a remote control unit. The computer preferably has both read only memory ("ROM") as well as read/write capability. The ROM can have a pre-programmed series of pitches which can be called up from the remote control unit created by use of the screen 170. In another embodiment software may utilized to instruct the computer to control the pitching machine in a particular pitching mode. The software may be in the form of cartridge, cassette, disks or other similar memory storage devices, including CD/ROM disks.

While the computer can be used to instruct the pitching machine to serve a particular series of pitches it can also be programmed to deliver by random selection a series of pitches without a predetermined order of selection. In this manner it can more nearly approximate the situation with which a batter is faced in a ball game. In another embodiment, the pitching sequence can be randomly selected from the repertoire of pitches of a known major league pitcher. Thus, the batter can experience the challenge of facing a particular pitcher whose pitching techniques are known and can be programmed into the computer.

The type of pitch delivered will depend on both the speed of the drive wheels and the difference in speed between the drive m wheels. In addition to variations in the type of pitch delivered the location of the pitch in the target area "strike zone" can be controlled by the pan/tilt machine which will control the elevation and horizontal location in the strike zone for ball delivery.

Figure 12:
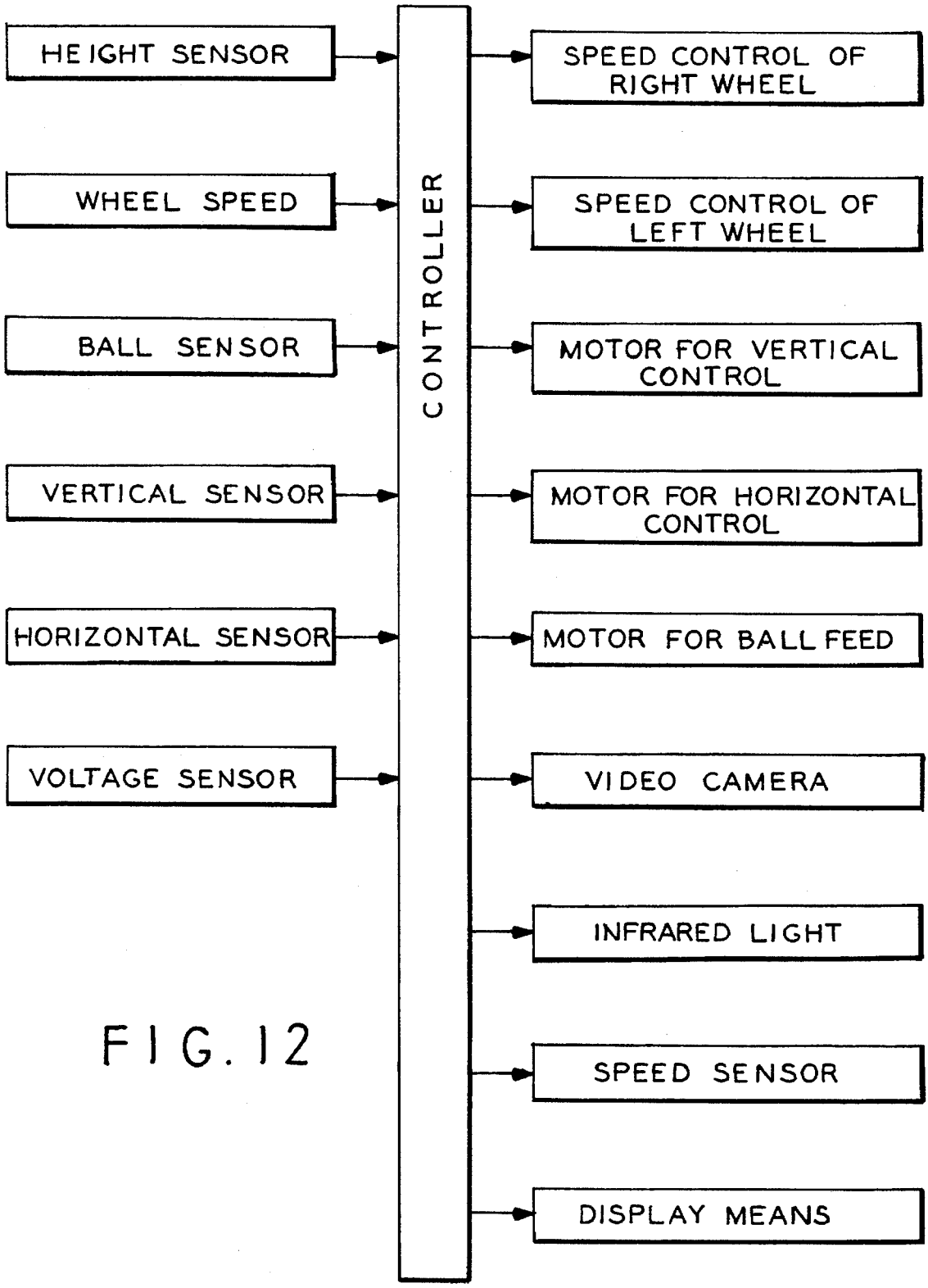
FIG. 12 is a block diagram of the control system in accordance with the invention.

FIG. 11 shows a typical schematic interface of a computer and FIG. 12 shows a typical block diagram of the control system.

It will be appreciated by those skilled in the art having access to this disclosure that it is necessary to fix the wheel speed of each drive wheel as well as the tilt and pan of the pitching machine in order to define a pitch sequence. The computer can be given the individual pieces of information separately in a predetermined sequence or it can be called upon to read the information from a pre-programmed sequence. In either event the computer then instructs the servo unit to set the various parameters of wheel speed, tilt and pan to accomplish the desired pitch.

The microcomputer comprises a CPU as well as memory storage locations. The term computer system means the combination of a computer, input means for instructing the computer, interpretation means permitting the computer to convert the instructions to commands by which the operation of the ball pitching machine is controlled to deliver a particular type of pitch to a predetermined location and servo mechanisms, drive motors and rheostats through which the commands are executed, thereby resulting in a pitched ball of a particular type, e.g., curve ball, fast ball, knuckle ball, slider, etc.

The main part of the machine is a microprocessor 150 with which the very high requirements in connection with the complicated real-time control of the moving parts and with the necessary arithmetic operations can be satisfied. For the given purpose, a low-cost eight bit microprocessor 150 with a clock frequency of 2 MHz is used. A static read/write memory 41 with 2 Kbyte capacity, an electrically programmable read-only memory 42 with a storage capacity of 16 Kbyte and an electrically erasable/programmable read-only memory for non-volatile program/data storage with a capacity of 128 byte are connected to the address and data buses of microprocessor 40.

While reference is made to trajectory as well as spin to determine the type of pitch, it will be appreciated by those skilled in the art having access to this disclosure that while the trajectory can generally be determined by adjusting the pan and tilt angles of the apparatus, the actual trajectory followed by the ball to the target area will also be effected by the spin which can cause the ball to curve or drop away from the straight line trajectory of a ball which has been delivered by the apparatus where both drive wheels are operated at the same speed. As used in the specification and claims "trajectory" refers to the line of flight of the ball unaffected by spin, but effected by pan and tilt angles.

To realize a data transfer to and from remote control unit 162, a two-channel input/output interface is applied, which communicates through an optocoupler with an interface. Interface includes circuits for driving and receiving the two-wire data link to remote control unit and, in addition, a transmitter/receiver circuit for the radio frequency link in the case of the wireless remote control.

In order to control drive motors 46, 48 of tires 58, 52, a device such as that disclosed in U.S. Pat. No. 4,442,823, issued Apr. 17, 1984 to Floyd et al., is used. In that apparatus, a four-channel counter/timer circuit can be utilized for timing the thyristor ignition pulses to the zero crossover of the main supply frequency. The counter/timer can control a dual flow-angle regulated thyristor power circuit for the motors through an optocoupler.

Another four-channel counter/timer circuit can serve for controlling the two position adjusting motors by regulating the level and the polarity of the voltages. The turning-on pulses, by proper timing, control dual power circuit through optocoupler for driving up/down adjusting motor and right/left adjusting motor, in order to achieve the desired angle of ejection.

An eight-channel parallel input circuit with its interrupt capability serves for receiving the input signals of sensors mounted on the moving parts of the launching mechanism. Input circuit receives the signals of upper wheel sensor, lower wheel turning sensor, up/down center position sensor, right/left center position sensor, up/down turning sensor and right/left turning sensor, through an interface and optocoupler.

An output interface circuit is applied in order to give light or sound signals for start indication of the following stroke with a signalling circuit and optocoupler.

A similar output interface connected to the microprocessor data bus serves for driving ball pushing motor in order to push the ball between the two rotating wheels. A regulated power supply will be turned on through optocoupler.

A trigger circuit with its long hold time connected to the non-maskable interrupt output of microprocessor serves to periodically interrupt request and calling hereby a built-in self-check routine in order to test the error-free operation of the system and avoid any disallowed program jumping due to occasional high electric field disturbances.

An optical three-channel parallel input/output circuit gives the possibility of a link through optocoupler to a host computer for software development or hardware test, or to connect more throwing machines to one another.

The block diagram of the operation is shown in FIG. 12 with the inputs and outputs noted.

Figure 13:
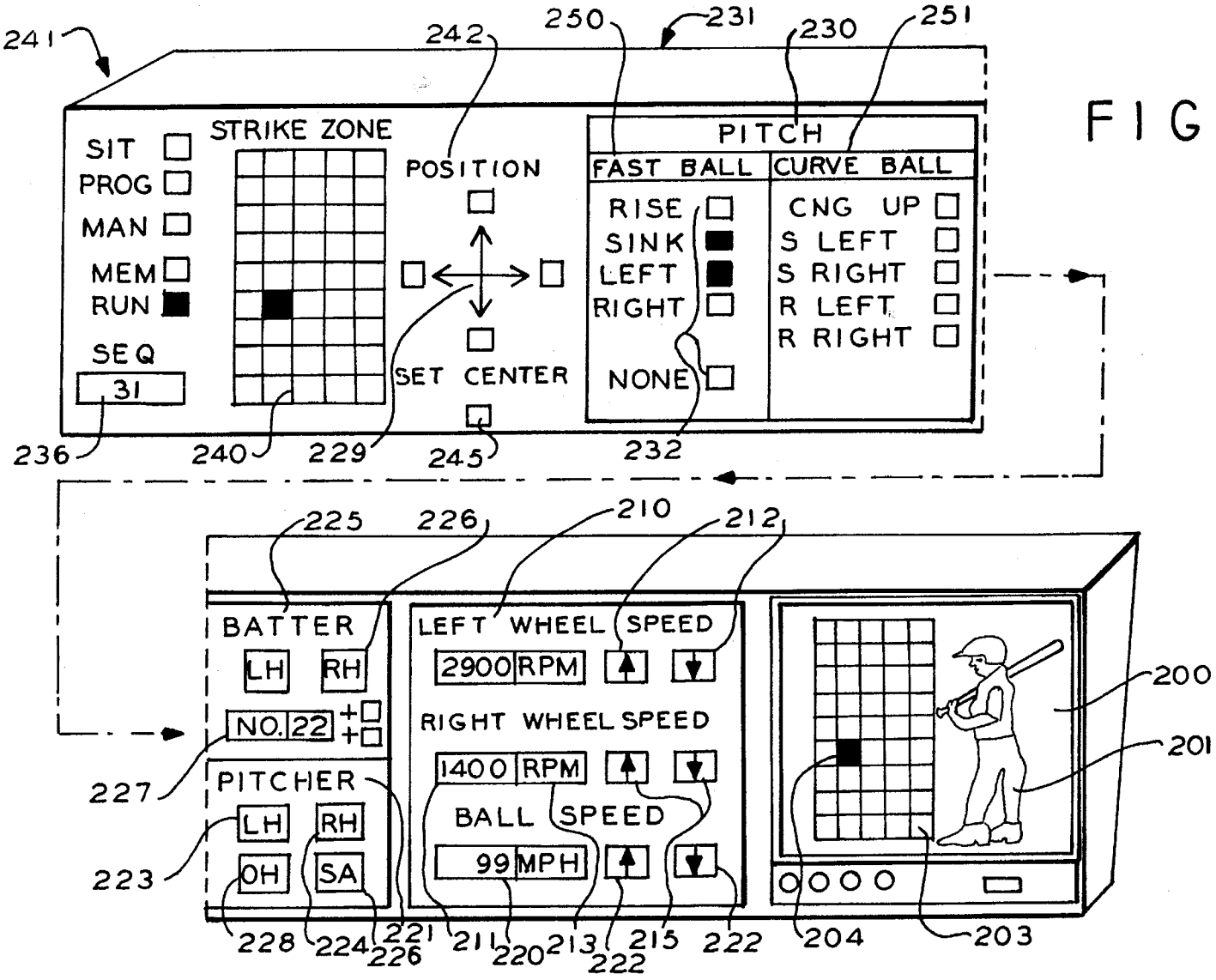
FIG. 13 is a view of the controlling unit which will be used to set up individual pitches and program in positions for prearranged memory selections.

A typical computer operated display unit is shown in FIG. 13. In this modification, a monitor 200 is connected directly with the video camera and shows the actual batter 201 and the vertical plane at the batter is shown on the screen as a grid 203. The place where the ball passes the batter is shown as a square mark 204 in the grid. This enables the operator to see if the pitched ball crosses the plate at the point intended. A delay circuit is used to retain the square on the screen for observation. The speed of one wheel which drives the ball (in the drawing indicated as the left wheel) is recorded in a read out display 210 in revolutions per minute (RPM). In like manner, the speed of the other wheel which drives the ball (indicated in the drawing as the right wheel) is shown in a read out 211 with the revolutions noted in RPM at 213. Arrows 212, 222 show by a directional arrow, up or down, to reflect the direction of the speed if it is changed. If desired, the particular batter's number can appear in a readout 227 with an indication that he is either a right-handed or left-handed batter 225, 226.

A readout can also be present which indicates the particular pitcher 221 who is being simulated and whether he is a right-handed 224 or left-handed 223 pitcher and if he pitchers sidearm 226 or overhand 228. A manual push button zone generally indicated at 231 can be on the panel which allows the operator, by pushing the appropriate button 232, to produce a rising, sinking, left or right fast ball. In like manner, a curve ball can be selected with a change up or left or right. A screen 240 is provided showing a series of grids corresponding with the grid in the vertical plane over the plate. By the use of a keyboard, mouse or similar control device the indicator shown as a black square can be placed in the selected position in the grid wanted for the pitch. This change of position is illustrated by the cross arrows 229 on the panel. When it is desired to return to the center position, the set center button 245 is pressed. At one end of the panel buttons are provided, generally indicated at 241, to set the apparatus in the automatic or manual mode. If a set sequence has been adopted, a readout 236 is provided to show the sequence which was selected.

Chart 1 below is an illustration of how the voltage fed to each motor operating the wheels can affect the type of pitch delivered. The speed and impact location of the ball is based on variations of voltage to the two motors driving the wheels which throw the ball of a typical pitching machine. If desirable, an additional variation can be inserted in Chart 1 to indicate the height from the ground at which the pitch starts out. Further, the third motor controls whether the wheels are in the vertical or horizontal configuration.

CHART 1

| MOTOR 1 | MOTOR 2 | MOTOR 3 | SPEED | CONTACT POINT |
|---|---|---|---|---|
| 2 volts | 2 volts | Horizontal | 80 mph | M |
| 3 volts | 2 volts | Horizontal | 90 mph | G |
| 2 volts | 3 volts | Horizontal | 90 mph | R |
| 4 volts | 2 volts | Horizontal | 100 mph | 22 |
| 2 volts | 2 volts | Vertical | 80 mph | M |
| 3 volts | 2 volts | vertical | 90 mph | G |
| 2 volts | 3 volts | Vertical | 90 mph | R |
| 4 volts | 2 volts | Vertical | 100 mph | 22 |

Chart 2 below is the assignment of arbitrary letters and numbers corresponding to the various possible points of impact on the screen 170. The letters indicate pitches with the strike zone of an average height batter, the numbers indicate pitches outside of the typical strike zone.

CHART 2
Location

| 1 | 2 | 3 | 4 | 5 | 6 | 7 | 8 |
|---|---|---|---|---|---|---|---|
| 9 | 10 | 11 | 12 | 13 | 14 | 15 | 16 |
| 17 | 18 | C | D | E | F | 19 | 20 |
| 21 | 22 | G | H | I | J | 23 | 24 |
| 25 | 26 | K | L | M | N | 27 | 28 |
| 29 | 30 | O | P | Q | R | 31 | 32 |
| 33 | 34 | S | T | U | V | 35 | 36 |
| 37 | 38 | 39 | 40 | 41 | 42 | 43 | 44 |

Having made the selection of variables for each type of pitch, the computer stores the information in its memory under a file name. To duplicate a desired pitch, it is only necessary to insert the file name, i.e., OH (overhand pitch to point H).

While the invention has been described in its preferred embodiment, it is to be understood that the words which have been used are words of description rather than limitation and that changes may be made within the purview of the appended claims without departing from the true scope and spirit of the invention in its broader aspects.

What is claimed is:

1. In a ball pitching machine comprising:

(a) a ball feed means for feeding balls to a feeding point where they will be acted upon by rotating drive wheels;

(b) two drive wheels having identical planes and axes of rotation, said wheels being disposed about said feeding point so as to simultaneously act on a fed ball imparting to the fed ball spin and a forward velocity and trajectory, outwardly away from the feeding point in a direction initially perpendicular to the axes of rotation and in the plane of the wheels;

(c) rotating means for rotating each drive wheel independent of other drive wheels at a plurality of preselected rotational speeds thereby effecting a type of pitched ball having a predetermined trajectory; the improvement which comprises a journaled horizontal cross-member to allow movement of the wheel from a vertical alignment to a horizontal alignment;

a separate motor associated with each drive wheel;

said motors rigidly affixed to said horizontal cross-member;

tilting means for altering the trajectory, upwardly or downwardly, in a vertical plane, coplaner with the plane of the drive wheel;

speed measuring means for determining the speed of the moving ball;

a computer means for inputting at least one set of variables that determine the trajectory based on the speed of the ball and at least one set of variables for effecting the spin applied to the ball by the drive wheel, thereby effecting the type of pitched ball delivered by the machine; said computer means interpreting said input and converting the input to commands by which a servo system controls the direction of the flight path and spin placed on the ball by the drive wheels, thereby causing the ball to be delivered to a specific location in a target area in a predetermined manner; and a monitor for selecting the area of impact of the ball, wherein a target screen is provided to predetermine the pitches to be utilize, wherein the target screen is a series of uniformly placed contact switches that will indicate contact when a ball impinges on the switch and wherein recording means are provided for recording the settings of speeds of the motors causing the ball to impact on the particular switch.

2. A ball pitching machine comprising:

a ball feeding means for feeding respectively balls to a feeding point where they will be acted upon by rotating wheels;

two rotatable wheels having planes and centers of rotation;

rotation means for rotating respective said wheels at a respective individual rotational speeds for acting on a fed ball and effecting a type of pitched ball with respective to a type curve, said rotation means being located at the opposite side of said wheels;

computer means for individually controlling the speed of the rotation means and height of said feeding point, which includes a video camera and a monitor for contemporaneously showing the location of the batter and a grid around the battery to which a pitch can be directed.

3. The ball pitching machine combination as defined in claim 2 wherein the rotation means comprises two motors for driving the wheels are located on opposite sides of each wheel.

4. The ball pitching machine combination of claim 3 wherein a speed means is provided for attaining a predetermined speed on each of said wheels.

5. The ball pitching machine combination as defined in claim 2 wherein a cover is provided for the pitching apparatus to prevent it from being seen by the batter.

6. The ball pitching machine combination as defined in claim 2 wherein a target screen is provided to predetermine the pitches to be utilized.

7. The ball pitching machine combination as defined in claim 6 wherein the target screen is a series of uniformly placed contact switches that will indicate contact when a ball impinges on the switch.

8. The ball pitching machine combination of claim 2 wherein said pitching machine includes a main azimuth means for effecting a plurality of predetermined trajectories at a plurality of azimuths in a horizontal plane.

9. The ball pitching machine combination of claim 2 wherein said pitching machine includes a means for calculating the speed of travel of each ball.

10. The ball pitching machine combination of claim 2 wherein said pitching machine includes a light beam means for directing to the area of the batter for aiding the aiming of the ball to be pitched.

11. The ball pitching machine combination of claim 2 wherein said pitching machine includes a lifting means for effecting a plurality of predetermined vertical positions for said feeding points for simulating kinds of pitching delivery heights.

12. The ball pitching machine as defined in claim 2 including a speed sensing means for determining the speed of travel of the pitched ball.

13. A ball pitching machine comprising:

a ball feeding means for feeding respectively balls to a feeding point where they will be acted upon by rotating wheels;

two rotatable wheels having planes and centers of rotation;.

rotation means for rotating respective said wheels at a respective individual rotational speeds for acting on a fed ball and effecting a type of pitched ball with respective to a type curve, said rotation means being located at the opposite side of said wheels;

computer means for individually controlling the speed of the rotation means at height of said feeding point and a video camera which maintains a horizontal configuration.

14. The ball pitching device of claim 13 wherein the computer is programmed to record the speed of the pitch and a location in a grid where the pitched ball passes.

* * * * *